US005414197A

United States Patent [19]

Wakeley et al.

[11] Patent Number: 5,414,197

[45] Date of Patent: May 9, 1995

[54] METHOD OF CONTAINING AND ISOLATING TOXIC OR HAZARDOUS WASTES

[75] Inventors: Lillian D. Wakeley; Judy C. Tom; Melvin C. Sykes; William N. Brabston; Philip G. Malone, all of Vicksburg, Miss.

[73] Assignee: The United States of America as represented by the Secretary of the Army, Washington, D.C.

[21] Appl. No.: 254,004

[22] Filed: Jun. 3, 1994

[51] Int. Cl.[6] ..... G21F 9/00

[52] U.S. Cl. ..... 588/3; 588/6; 588/8; 588/255; 264/0.5; 252/625; 976/DIG. 385; 427/6

[58] Field of Search ..... 588/3, 6, 8, 255; 264/0.5; 252/625; 976/DIG. 385; 427/6

[56] References Cited

U.S. PATENT DOCUMENTS

| | | | |
|---|---|---|---|
| 4,020,003 | 4/1977 | Steinberg et al. | 588/4 |
| 4,234,632 | 11/1980 | Lubowitz | 428/2 |
| 4,354,954 | 10/1982 | Koster et al. | 588/4 |
| 4,363,757 | 12/1982 | Koster et al. | 588/3 |
| 4,534,893 | 8/1985 | Dippel et al. | 588/11 |
| 4,828,761 | 5/1989 | Mattus et al. | 588/4 |
| 4,839,102 | 6/1989 | Kertesz et al. | 588/4 |
| 4,904,416 | 2/1990 | Sudo et al. | 588/3 |
| 5,075,045 | 12/1991 | Manchak, Jr. et al. | 588/6 |
| 5,164,123 | 11/1992 | Goudy, Jr. | 588/6 |

OTHER PUBLICATIONS

CA 104:173971.

*Primary Examiner*—Ngoclan T. Mai

*Attorney, Agent, or Firm*—Luther A. Marsh

[57] ABSTRACT

A method of containing hazardous and toxic wastes includes the steps of incorporating the dried waste, in a salt form, in melted polymer, such as asphalt, and forming the waste salt and asphalt blend into aggregate pellets. The pellets are coated with a powdered coating material that is compatible with a portland cement-based mortar or other cementitious material which is used. The coated particles are mixed with mortar to form a polymer-aggregate concrete and cast into wasteforms for storage or burial. If it is desirable to produce a waste form with a continuous layer of mortar on the exterior of the concrete monolith the mold can be placed on a turntable and spun, or otherwise exposed to a centrifugal force to force the mortar to the outside of the mold. Centrifugal separation is possible because the polymer-waste mixture typically has a specific gravity near 1.5 while that of the cementitious mixture is typically greater than 2.0.

18 Claims, 1 Drawing Sheet

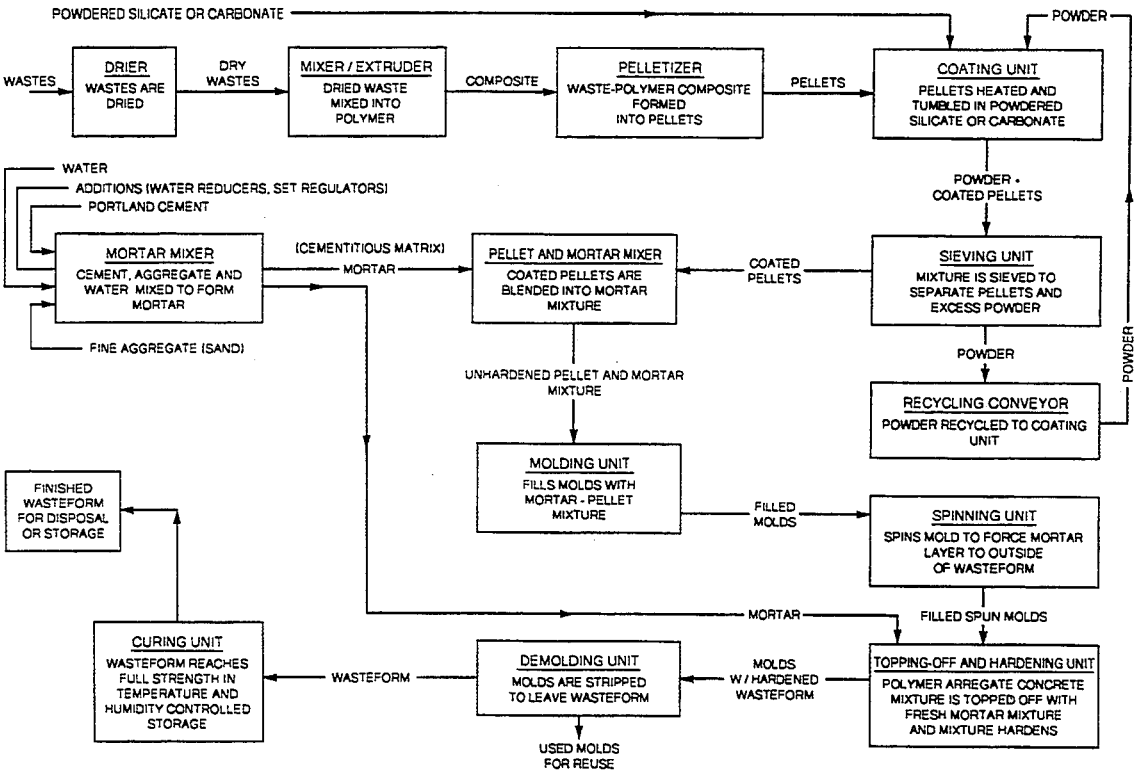

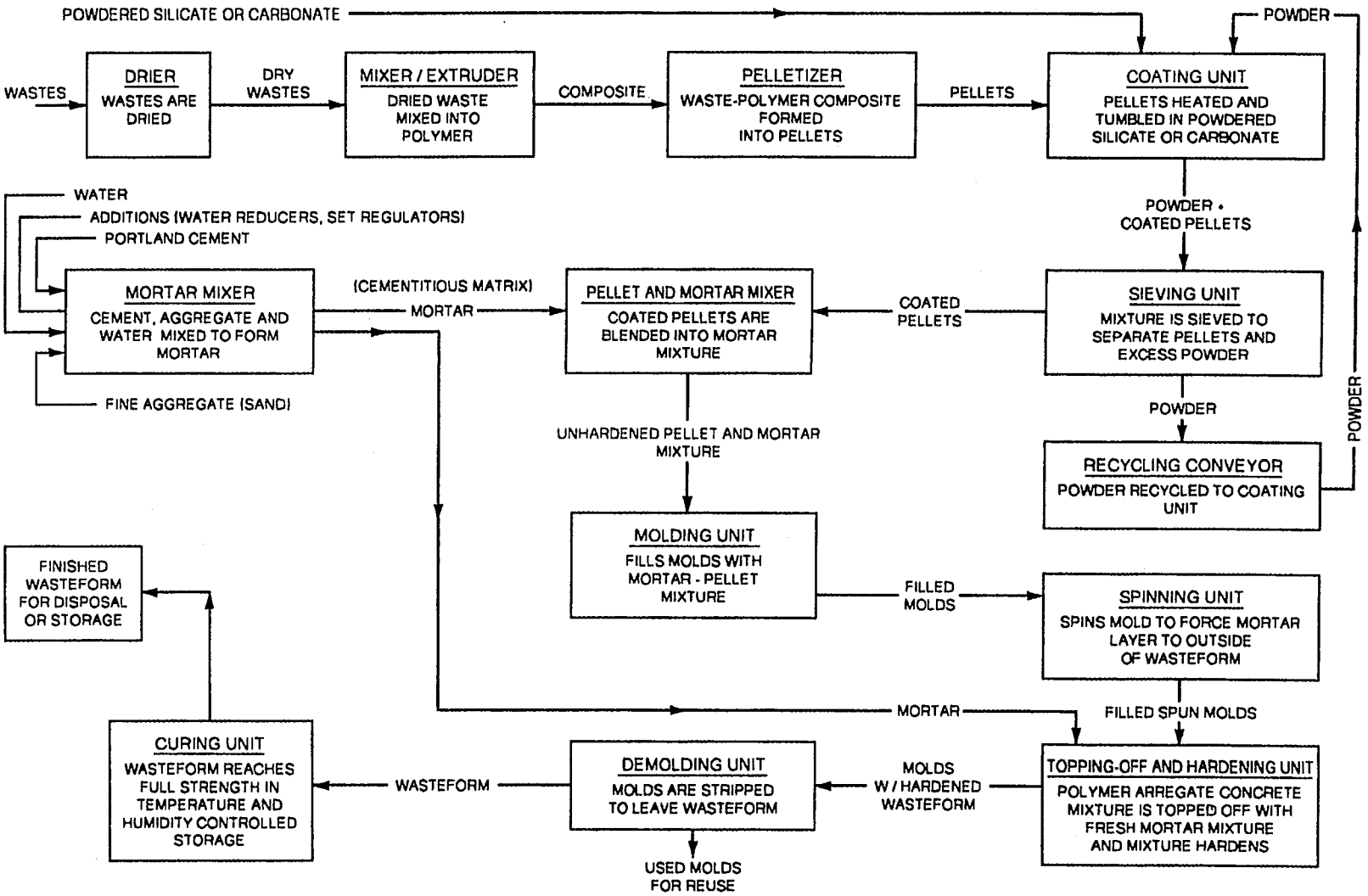
WASTES
DRIER
WASTES ARE DRIED
DRY WASTES
MIXER / EXTRUDER
DRIED WASTE MIXED INTO POLYMER
COMPOSITE
PELLETIZER
WASTE-POLYMER COMPOSITE FORMED INTO PELLETS
PELLETS
POWDERED SILICATE OR CARBONATE
POWDER
COATING UNIT
PELLETS HEATED AND TUMBLED IN POWDERED SILICATE OR CARBONATE
POWDER + COATED PELLETS
SIEVING UNIT
MIXTURE IS SIEVED TO SEPARATE PELLETS AND EXCESS POWDER
POWDER
RECYCLING CONVEYOR
POWDER RECYCLED TO COATING UNIT
POWDER
COATED PELLETS
PELLET AND MORTAR MIXER
COATED PELLETS ARE BLENDED INTO MORTAR MIXTURE
UNHARDENED PELLET AND MORTAR MIXTURE
MOLDING UNIT
FILLS MOLDS WITH MORTAR - PELLET MIXTURE
FILLED MOLDS
SPINNING UNIT
SPINS MOLD TO FORCE MORTAR LAYER TO OUTSIDE OF WASTEFORM
FILLED SPUN MOLDS
TOPPING-OFF AND HARDENING UNIT
POLYMER ARREGATE CONCRETE MIXTURE IS TOPPED OFF WITH FRESH MORTAR MIXTURE AND MIXTURE HARDENS
MORTAR
MOLDS W / HARDENED WASTEFORM
DEMOLDING UNIT
MOLDS ARE STRIPPED TO LEAVE WASTEFORM
USED MOLDS FOR REUSE
WASTEFORM
CURING UNIT
WASTEFORM REACHES FULL STRENGTH IN TEMPERATURE AND HUMIDITY CONTROLLED STORAGE
FINISHED WASTEFORM FOR DISPOSAL OR STORAGE
(CEMENTITIOUS MATRIX)
MORTAR
MORTAR MIXER
CEMENT, AGGREGATE AND WATER MIXED TO FORM MORTAR
WATER
ADDITIONS (WATER REDUCERS, SET REGULATORS)
PORTLAND CEMENT
FINE AGGREGATE (SAND)

METHOD OF CONTAINING AND ISOLATING TOXIC OR HAZARDOUS WASTES

FIELD OF THE INVENTION

The present invention relates to methods of containing and isolating toxic or hazardous wastes by forming an aggregate of the waste in asphalt or other polymers and subsequently incorporating the aggregate in a cementitious matrix. More particularly, the present invention relates to a method of containing low-level radioactive wastes comprising encapsulating the waste in asphalt to form an aggregate, mixing the aggregate in portland cement and exerting a centrifugal force on the mixture before hardening of the portland cement.

BACKGROUND OF THE INVENTION

Standard practice in the disposal of toxic wastes or low-level radioactive wastes requires incorporating the wastes into a non-leaching or low-leaching wasteform and burying the wasteform in a permitted site. The usual strategies for producing a wasteform involve blending the solid (sludge or salt) and liquid waste as a slurry in a dry mixture that contains a filler and a cementitious product such as portland cement or fly ash and lime. Because cement-based wasteforms have some porosity and may leach salts, an alternate strategy has involved mixing dry waste salts into a thermosetting polymer such as asphalt or polyethylene. Neither technique is totally satisfactory when used alone.

Portland cement-based wasteforms present problems due to the interaction of the waste and the cement, which can prevent the wasteform from solidifying; cause the wasteform to solidify too quickly; or cause the wasteform to lose strength after initially hardening. The problems related to interferences with the cementing reactions are so great that with a typical sulfate or nitrate waste, the salt loading is typically less than 15 percent of the mass of the wasteform. If detergents or surfactants are present the loading may have to be even lower. Although the wasteforms made as cement-based composites can be manufactured as strong, coherent masses, they still show porosity that is typically in the range observed in concrete. Soluble salts will be leached from these wasteforms if they are exposed to groundwater.

Asphalt-based wasteforms have been widely used for disposal of low-level radioactive wastes, especially those containing soluble salts. This is because the wasteform can be manufactured with dried salts and because leaching rates are generally very low due to the hydrophobic nature of the material. When asphalt, polyethylene, or other polymers are used to encapsulate waste, problems arise from the combustibility of organic materials when mixed with strong oxidizers, such as chlorates and nitrates. Radiation from the enclosed wastes can degrade the polymer and generate hydrogen gas. As the hydrogen gas accumulates it pressurizes the containers holding the asphalt thus creating an explosive potential.

In past applications of solidification in waste disposal, the accepted approach to forming a solid from a waste has been to mix the waste as a slurry, solution or dry solid with an organic or inorganic cementing or encapsulating medium and to create conditions that would allow the cementing medium to harden. This technology has been documented for both radioactive wastes (Dlouhy, Zdenek, 1982. *Disposal of Radioactive Wastes*, Elsevier Scientific Publ. New York, and conventional industrial wastes (U.S. EPA 1980. *Guide to the Disposal of Chemically Stabilized and Solidified Waste*, SW-872, U.S. EPA, Washington, D.C.).

Waste composites have been fabricated using organic polymers and portland cement-based mortars; but in prior applications, the mortar and the polymers have been mixed together to let the organic polymer fill the void space in the hardened mortar. For example, SYNCRETE, a polymer-portland cement mixture developed for waste disposal involves mixing water, a polymer emulsion, portland cement, wastes and a catalyst to produce a hardened block containing wastes (Cohen, S., P. Crouzet, 1986. "*SYNCRETE: A highly efficient polymer cement embedding matrix for waste processing*". Waste Management '86, *Waste Isolation in the US.*-Proceedings of the Symposium, March 2–6, 1986, Tucson, AZ, pp 583–588). The polymer interpenetrating the matrix produced by the hydration of the calcium silicate in the portland cement is thought to produce the exceptional strength observed in this composite. Unfortunately, the polymer does not isolate the waste and the components in the waste can prevent the polymerization of the polymer and also stop the hardening reactions that occur in the portland cement. The present invention differs significantly from the SYNCRETE approach because the new system isolates the waste in a polymer and coats the polymer-waste mixture before the waste is added to the portland cement-based mortar. The new technology represents a significant improvement over the prior art because it prevents any of the components in the waste from interfering with the setting reactions that occur in the portland cement hydration.

Dlouhy (1982) describes another wasteform that is manufactured by mixing the waste with portland cement to form a weak block that is then strengthened by impregnating the block with organic polymer. Unfortunately, this technique requires that the block be vacuum dried at 165 degrees C. and soaked in the heated polymer. In the example cited, the block is held in liquid styrene at 85 degrees C. for 40 hours. (Dlouhy, Zdenek 1982. *Disposal of Radioactive Wastes*, Elsevier Scientific Publ. Co. New York, NY p. 138). The new technique does not involve polymer impregnation and can proceed faster with the advantage that the wastes will not weaken the portland cement matrix, and no final impregnation will be required. The polymer impregnation also has a significant disadvantage in that it is difficult to insure that the polymer in the waste block has polymerized without breaking or coring the block. Both of these steps destroy the integrity of the waste block. In the new system the condition of the waste-polymer composite can be determined by inspection prior to the addition of the pellets of composite to the portland cement-based matrix.

An alternate method for encapsulating wastes in polyethylene was proposed by Lubowitz et. al., in 1977. In the method discussed by Lubowitz et. al., dried wastes were stirred into an acetone solution of modified 1,2-polybutadiene for five minutes and then the waste/-polymer mixture was allowed to set for two hours. The polymer-impregnated particles are placed in a mold and subjected to mechanical pressure and heated to between 120 and 200 degrees C. to produce fusion. A polyethylene jacket approximately 3.5 mm ($\frac{1}{2}$ in.) thick is fused over the solid block. The proposed disposal method would use 800 to 1000 lb. blocks (Lubowitz, H. R., R. L. Denham, and G. A. Zakrzewski, 1977 *Development of a Polymeric Cementing and Encapsulating Process for Managing Hazardous Wastes.* U.S. EPA Publ. EPA-600/2-77-045, U.S. EPA, Cincinnati, Ohio,. This technique has serious drawbacks in that all of the organic polymers and solvents used are flammable. If an oxidizer (such as chlorate or nitrate) is mixed with acetone and polybutadiene and heated, care must be taken to avoid a fire. Also the polyethylene jacket can deform (squeeze thin) under pressure and can be punctured. Damage in handling and stacking can compromise the integrity of the outer polyethylene jacket. In contrast, the new technique avoids these problems by using only thermoplastic media and techniques that have been routinely used with oxidizing salts and embeds coated pellets of organic polymer in a portland-cement mortar mix that will not flow or deform plasticly and poses no risk of fire. Furthermore, the organic polymer is distributed through an inorganic matrix that separates the pellets and destroys the physical continuity of the combustible material.

SUMMARY OF THE INVENTION

According to the present invention many of the problems associated with the wasteforms discussed above can be eliminated by providing a new waste form which benefits from the advantages of both those prior art wasteforms. According to the present invention, pellets of asphalt-encapsulated or polymerencapsulated wastes are used as an aggregate in a concrete mixture that has the low-leaching characteristics of an asphalt or organic polymer wasteform; and the strength, durability, and desirable chemical characteristics of a portland cement-based wasteform. Organic polymers such as asphalt or polyethylene are compatible with concrete. Asphalt has typically been used as a sealer over concrete. Naturally brittle asphaltenes, such as gilsonite, have been used as an aggregate to produce low-density concrete.

Because of the plastic nature of asphalt-based wasteforms, they are enclosed in a shippable container (usually a steel drum) for transportation and disposal. The drum adds to the cost of the wasteform and provides only temporary (15–20 year) containment if the drums are buried. By incorporating asphalt particles in concrete, containment can be extended well beyond what would be the predicted life of a buried steel drum. The elimination of the drum lowers the cost of the wasteform.

Waste salts that are oxidizers (nitrates, chlorates, etc.) can form potentially flammable mixtures that can burn without access to air. Salts such as nitrates mixed with asphalt may result in the equivalent of a solid rocket fuel. Using the new technology of the present invention and isolating the asphalt as pellets in a concrete matrix greatly reduces the potential for ignition of the asphalt-oxidizer mixture. With the contact between pellets reduced, a large, continuous fire also becomes much less likely; although individual exposed pellets may burn if ignited.

It has been shown that when radioactive wastes are incorporated in asphalt or other organic polymers, the radiation breaks down the organic polymer and generates hydrogen gas. I the wasteform is sealed in a drum, hydrogen gas can accumulate and pressurize the drum creating a serious safety problem. The mortar matrix of the present invention allows hydrogen gas to diffuse out of the wasteform without producing dangerous gas accumulations or pressurized containers.

Asphalt wasteforms are developed for long-term containment of wastes that will be hazardous for hundreds of years. The wasteforms may be excavated at some future date when the nature of the material is long forgotten. Subsequent use of the wastes may expose humans to hazards of toxicity or radioactivity. If the new technique is employed and the asphalt is dispersed through a mortar matrix, it is far less likely that the asphalt will ever be reclaimed and reintroduced into the environment.

BRIEF DESCRIPTION OF THE DRAWING

The present invention may be more fully understood with reference to the appended drawing which is a process flow diagram of a method embodying the present invention.

DETAILED DESCRIPTION OF THE INVENTION

The present invention relates to a method which includes the steps of incorporating the waste into melted asphalt or other polymer and forming the waste-polymer blend into aggregate pellets for concrete. The pellets (used as aggregate) are coated with powdered siliceous or carbonate material to improve bonding between the pellets and the cementitious matrix. The coated pellets are mixed into a cementitious matrix to form a concrete. This concrete with polymer aggregate is cast into wasteforms for storage or burial. It is desirable to produce a wasteform with the polymer-waste composite in the center of the concrete monolith. To accomplish this, the mold can be placed on a turntable and spun, or otherwise exposed to a centrifugal force, to force the matrix material into a continuous layer on the outside of the wasteform. The polymer-waste pellets typically have a specific gravity near 1.5 while that of the cementitious matrix is greater than 2.0. This difference in density makes it possible to separate the materials by spinning.

The wasteform of the present invention is safer and more durable than either of the earlier wasteforms. The new wasteforms can be cast as discrete, self-supporting units of a convenient size and shape that can be stored, transported, and retrieved as required by regulations. This technology does not require that the wasteform be permanently cast in a trench or vault. The waste can be cast as blocks with all exterior surfaces consisting of uncontaminated, normal-strength concrete. No containers or crates should be required to maintain the shape of the wasteform.

According to the present invention, the problem of holding soluble salts in a porous medium such as concrete is overcome. The leaching characteristics of the composite are controlled by the polymer encapsulation, not by the cementitious matrix. The major problem with cement-based systems has been the interaction of the wastes with the cement which weakens the resulting solid. By initially isolating the waste, especially the soluble salt, in a polymer, chemical interaction between the cement and the wastes cannot occur.

Typically, polymer wasteforms will contain 40–60% waste by mass. It would be useful to have an outer layer of uncontaminated material around the waste to improve waste isolation and, in the case of radioactive wastes, to provide radiation shielding. According to the present invention, the polymer aggregate is disposed in a flowable cementitious mixture and a shielding layer is formed by modifying the wasteform casting process. Because the polymer-waste pellets used as aggregate are much less dense than the unhardened mortar mixture, if the mold is spun during the casting process the heavier mortar mixture will be forced to the outside. When the concrete then hardens, the polymer with the waste enclosed will be concentrated in the center of the concrete mass and a layer of clean, uncontaminated concrete will be formed on the outside of the wasteform. This monolith with the waste concentrated in the center is a wasteform that is safer to handle and less likely to release waste through diffusion. The present inventors know of no other waste disposal technique that involves mixing materials having different densities and separating the materials by spinning.

Some asphalt wasteforms have been shown to expand and form surface cracks if they are free to swell in contact with water. The concrete shell can provide confining pressure to prevent the asphalt from expanding and can limit the exposure of the asphalt surface to water.

Cement-based wasteforms have been favored in the past because of the relatively high pH maintained in the matrix. The high pH reduces the solubility of many metal salts that are common in wastes and a problem to the environment. For example, cadmium and lead are typically more soluble in acid than alkaline aqueous systems. It has not been possible to develop this type of chemical barrier with asphalt alone. Thus, the present invention provides both the chemical barrier from the high pH and the improved containment of a polymer wasteform.

Many materials that are plastic in nature may be used for making pellets. Polyethylene, asphalt, elemental sulfur, and other organic and inorganic materials that are thermoplastic may be used.

The waste to be contained and isolated usually begins in the form of a slurry or a solution. The waste is first dried to remove free liquid. The result of this drying step is a dry waste salt. Preferably, a spray evaporator dryer is used which produces a hot, dry salt. The salt product is then mixed or kneaded into the thermosetting polymer after the polymer has been heated to form a liquid or a plastic solid. The resultant mixture is then formed into pellets.

Pellets can be formed by making long strips of the waste salt-polymer mixture and cutting the strips into pellet-sized forms. An extruder may be used to form the strips and the strips may be cut as they exit the extruder. Of course, other methods of forming pellets, particularly spherical pellets, can alternatively be used.

The pellets can be of various sizes and shapes. For a wasteform monolith weighing approximately 75 pounds, the ideal pellet is roughly equidimensional and is between 0.5 to 2.0 inches in size. Spherical pellets for this size of monolith should have an average diameter between 0.5 and 2.0 inches. This last-mentioned range is a good size for pellets to be used in a monolith which has a size in the range of a 6-inch cube to a 12-inch cube. A monolith size of about a 10-inch cube may be preferred in order to achieve a size which could be handled conveniently. The preferable shape for a monolith would be a cube or a cylinder. The maximum size of a pellet should typically be no larger than one-third of the smallest dimension of the monolith.

The pellets are then rolled in or otherwise coated with a fine granular or powdered inorganic compound, such as sand, to improve bonding of the pellet to the cementitious matrix. The pellets are coated with the granular or powdered material while the thermosetting material is in a plastic or semi-solid condition. Heating and tumbling causes adhesion of the grains of powder to the exterior of the pellets. The pellets are then cooled, removed from the powder, and incorporated in the cementitious matrix.

Any cementitious or pozzolanic material, fumed silica, ground limestone, fly ash, ground clay, portland cement, sand or ground slag may be used to coat the pellets. Portland cement is a preferred coating substance.

The coated pellets are then mixed with a cementitious matrix such as mortar and the mixture is allowed to harden. Alternatively, the mixture may be spun before hardening to force the heavier cementitious matrix to the outside of the monolith.

Tests were done with 2-inch diameter by 4-inch long cylinders prepared according to a method of the present invention using a simulated salt waste mixed in asphalt. The tests showed that because there was no loss of strength due to the reactions between the cementitious matrix and the waste it was possible to develop cylinders with unconfined compressive strengths of over 1000 psi using a simple mortar design with Type I–II portland cement. Spinning the samples moved the fresh mortar mixture to the outside of the wasteform. The sample products had a smooth, dust-free exterior surface with no exposed asphalt aggregate.

In the above examples salt loadings were below 10% by mass. In a typical concrete, coarse aggregate would form approximately one-half of the volume of a concrete mixture. Assuming a mortar consisting of sand and cement is used as a matrix, replacing the coarse aggregate with pellets of asphalt containing 60% salt would result in a wasteform that contained approximately 20% by mass salt. The wasteforms prepared according to the method of the present invention can have salt loadings comparable to or higher than those wasteforms prepared by mixing waste salt directly into a cementitious matrix.

According to the present invention, even salts containing large amounts of chelating agents that would normally require very low salt loading levels (below 1% by mass) can be added into a wasteform without changing the cement content in the matrix.

Although the present invention has been described in connection with preferred embodiments, it will be appreciated by those skilled in the art that additions, modifications, substitutions and deletions not specifically described may be made without departing from the spirit and scope of the invention defined in the appended claims.

What is claimed is:

1. A method of containing and isolating toxic or hazardous wastes comprising the steps of:

removing liquid phase from a toxic or hazardous waste to form a dry waste salt;

mixing said dry waste salt into a molten thermosetting polymer to form a first mixture;

forming pellets of said first mixture;

allowing said molten thermosetting polymer to thermoset;

heating and coating said pellets with a powdered material which is compatible with a cementitious mixture to form coated pellets;

mixing said coated pellets with said cementitious mixture to form a polymer-aggregate concrete; and allowing said polymer-aggregate concrete to harden.

2. A method as claimed in claim 1, wherein said pellets have a density and said cementitious mixture has a density which is greater than the density of said pellets, said method further including the step of disposing said polymer-aggregate concrete in a mold and spinning said mold to centrifugally force said cementitious mixture toward an outside portion of said mold and allowing said polymer-aggregate concrete to harden.

3. A method as claimed in claim 1, wherein said thermosetting polymer comprises at least one member selected from the group consisting of asphalt, polyethylene and elemental sulfur.

4. A method as claimed in claim 1, wherein said cementitious mixture comprises portland cement.

5. A method as claimed in claim 1, wherein said cementitious mixture is a mortar containing portland cement and sand.

6. A method as claimed in claim 1, wherein said powdered material comprises at least one member selected from the group consisting of ground slag, sand, fly ash, fumed silica, calcium carbonate, portland cement, ground limestone, ground clay.

7. A method as claimed in claim 1, wherein said powdered material comprises portland cement.

8. A method as claimed in claim 1, wherein said powdered material comprises ground clay.

9. A method as claimed in claim 1, wherein said powdered material comprises calcium carbonate.

10. A method as claimed in claim 1, wherein said thermosetting polymer is an asphalt and said powdered material is portland cement.

11. A method as claimed in claim 1, wherein said pellets are substantially spherical and have an average diameter of between about 0.5 inch and about 2.0 inches.

12. A wasteform produced by the method according to claim 1.

13. A wasteform produced by the method according to claim 2.

14. A wasteform produced by the method according to claim 3.

15. A wasteform produced by the method according to claim 6.

16. A wasteform containing and isolating toxic or hazardous wastes, said wasteform comprising:

a matrix comprising a cementitious mixture surrounding a plurality of waste pellets therein, each said pellet comprising a salt of a toxic or hazardous waste encapsulated in a thermosetting polymer and coated with a powdered or granular material which is compatible with said cementitious mixture.

17. A wasteform as claimed in claim 16, wherein the cementitious mixture forms a continuous coating on the outer portion of said wasteform.

18. A wasteform as claimed in claim 16, wherein said toxic or hazardous waste comprises a radioactive material.

* * * * *